US012065844B2

(12) United States Patent
Routh et al.

(10) Patent No.: US 12,065,844 B2
(45) Date of Patent: Aug. 20, 2024

(54) LARGE AREA SLAB PANEL FORMWORK SYSTEM

(71) Applicant: PERI SE, Weissenhorn (DE)

(72) Inventors: Anibrata Routh, Weissenhorn (DE); K S Arun, Weissenhorn (DE); C N V S Rao, Weissenhorn (DE); A Sharanappa, Weissenhorn (DE)

(73) Assignee: PERI SE, Weissenhorn (DE)

( * ) Notice: Subject to any disclaimer, the term of this patent is extended or adjusted under 35 U.S.C. 154(b) by 0 days.

(21) Appl. No.: 16/699,531

(22) Filed: Nov. 29, 2019

(65) Prior Publication Data

US 2020/0173183 A1 Jun. 4, 2020

(30) Foreign Application Priority Data

Nov. 29, 2018 (IN) ..... 201841045177

(51) Int. Cl.
*E04G 11/48* (2006.01)
*E04G 9/02* (2006.01)

(52) U.S. Cl.
CPC ..... *E04G 11/486* (2013.01); *E04G 9/02* (2013.01); *E04G 11/483* (2013.01)

(58) Field of Classification Search
CPC ..... E04G 11/38; E04G 11/48; E04G 11/483; E04G 11/486; E04G 2025/006
USPC ..... 249/18
See application file for complete search history.

(56) References Cited

U.S. PATENT DOCUMENTS 1,907,877 A * 5/1933 Roos ..... E04G 11/486 249/193
3,771,756 A * 11/1973 Pipala ..... E04G 25/06 249/31
3,784,151 A * 1/1974 Steele ..... E04G 25/02 249/18
4,147,321 A * 4/1979 Gostling ..... E04G 11/486 248/354.1
7,640,871 B2 * 1/2010 Arozena Bergaretxe ..... E04G 11/486 108/150
9,004,443 B2 * 4/2015 Zhang ..... E04G 11/486 249/18

(Continued)

FOREIGN PATENT DOCUMENTS

CA 2698537 A1 * 3/2008 ..... E04G 11/486
CA 2803424 A1 * 7/2014 ..... E04G 11/486

(Continued)

OTHER PUBLICATIONS

Translation of CN 101591973 A. (Year: 2009).*

(Continued)

*Primary Examiner* — Brent W Herring
(74) *Attorney, Agent, or Firm* — SLEMAN & LUND LLP

(57) ABSTRACT

The various embodiments of the present invention provide a modular slab formwork with easy shuttering and de-shuttering assembly. The formwork comprises a formwork panel and a drophead. The formwork panel comprises a plurality of side connectors, a base frame, and a form-lining. The base frame comprises a corner element on each corner. The drophead is connected to each corner of the formwork panel through the corner element. The corner element forms a locking notch to lock at least two formwork panel with each other as well as with the drophead.

7 Claims, 7 Drawing Sheets

(56) References Cited

U.S. PATENT DOCUMENTS

Figure 1:
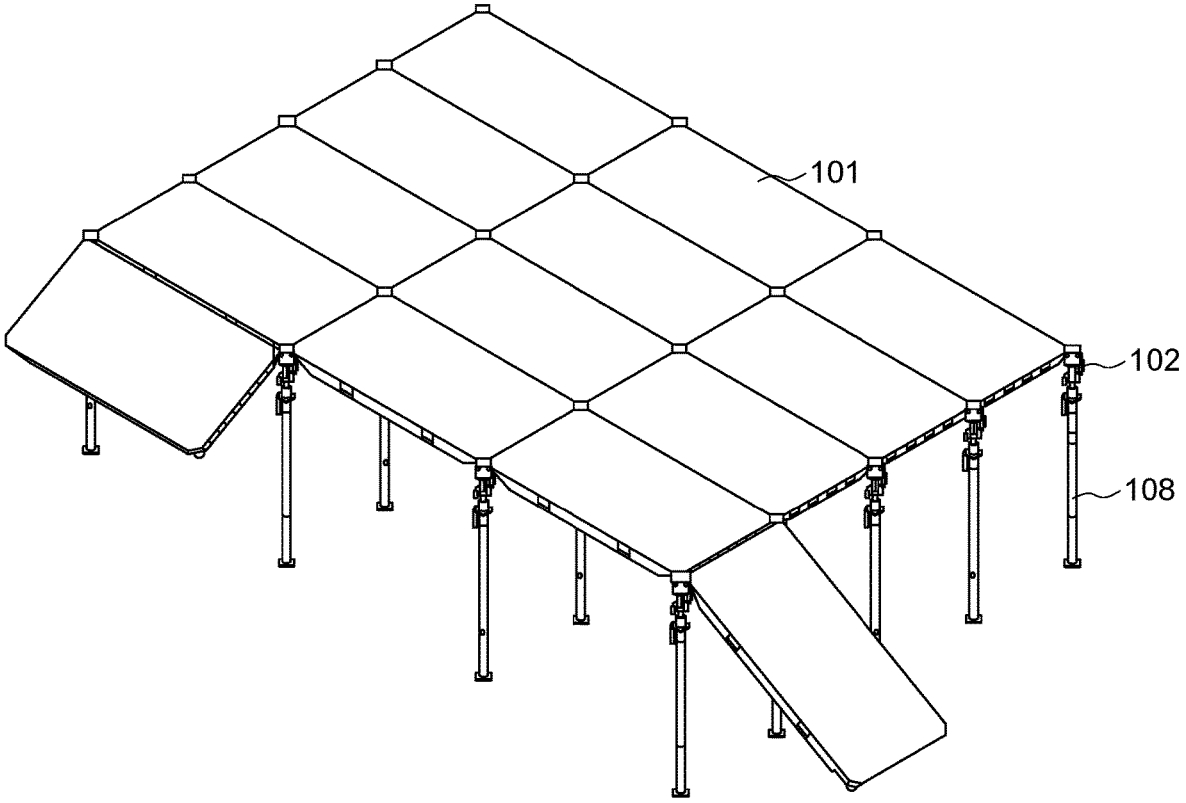

| | | | | |
|---|---|---|---|---|
| 10,053,875 | B1 * | 8/2018 | Baron | E04G 25/061 |
| 10,053,877 | B2 * | 8/2018 | Lenkin | E04B 5/10 |
| 2004/0075042 | A1 * | 4/2004 | Arozena Bergaretxe | E04G 11/486 249/210 |
| 2012/0042600 | A1 * | 2/2012 | Bacon | E04G 11/486 52/632 |
| 2014/0263941 | A1 * | 9/2014 | Zhang | E04G 11/06 249/18 |
| 2016/0060882 | A1 * | 3/2016 | Bond | E04G 11/38 264/34 |
| 2018/0334818 | A1 * | 11/2018 | Lenkin | E04G 11/483 |
| 2019/0010717 | A1 * | 1/2019 | Baron | E04G 11/38 |

FOREIGN PATENT DOCUMENTS

| | | | | | |
|---|---|---|---|---|---|
| CA | 3037043 | A1 * | 3/2018 | | E04G 11/50 |
| CA | 2988166 | A1 * | 3/2019 | | E04G 11/483 |
| CN | 101591973 | A * | 12/2009 | | |
| CN | 201416268 | Y | 3/2010 | | |
| CN | 204126259 | U * | 1/2015 | | E04G 11/486 |
| CN | 106337559 | A | 1/2017 | | |
| CN | 108385969 | * | 8/2018 | | |
| CN | 108385969 | A | 8/2018 | | |
| DE | 3147081 | A1 * | 12/1982 | | E04G 11/486 |
| DE | 3921064 | A1 * | 1/1991 | | E04G 11/50 |
| DE | 29705696 | U1 | 5/1997 | | |
| DE | 19629321 | A1 * | 1/1998 | | E04G 11/48 |
| DE | 102004004883 | A1 * | 3/2005 | | E04G 11/50 |
| DE | 102010001042 | A1 * | 7/2011 | | |
| EP | 0380149 | A1 * | 8/1990 | | E04G 11/50 |
| EP | 2570568 | A2 | 3/2013 | | |
| EP | 2749713 | A1 * | 7/2014 | | E04G 11/38 |
| EP | 2759658 | A1 * | 7/2014 | | E04G 11/486 |
| FR | 680981 | A * | 5/1930 | | |
| FR | 2957957 | A1 * | 9/2011 | | E04G 11/486 |
| GB | 1191578 | A * | 5/1970 | | E04G 11/486 |
| GB | 2107776 | A * | 5/1983 | | E04G 25/066 |
| WO | WO-02084050 | A1 * | 10/2002 | | E04G 11/48 |
| WO | WO-2006100694 | * | 9/2006 | | |
| WO | WO-2011089148 | A1 * | 7/2011 | | E04G 11/50 |
| WO | WO-2014124695 | A1 * | 8/2014 | | E04G 11/02 |
| WO | WO-2017093233 | A1 * | 6/2017 | | E04G 17/005 |

OTHER PUBLICATIONS

Translation of CN 108385969 A. (Year: 2018).*

"Elememt-Deckenschalung Dokadek 30", Sep. 1, 2012 (Sep. 1, 2012), pp. 1-16, XP055078191, Malsach (DE), Retrieved from the Internet: URL:http://www.doka.com/web/media/files/Dokadek_30_Sales_Handout_DE.pdf, retrieved on Sep. 9, 2013.

* cited by examiner

LARGE AREA SLAB PANEL FORMWORK SYSTEM

A) TECHNICAL FIELD OF INVENTION

The present invention generally relates to a construction device and system and particularly relates to a slab formwork system with modular assembly having panels covering larger areas with multidirectional erection possibilities, fast efficient and highly productive.

B) BACKGROUND OF THE INVENTION

In the construction of concrete buildings, it is known to employ, for the casting of ceilings, a slab formwork comprising panel support beams mounted on shores and panels supported on the panel support beams. It is further known to provide the shores with dropheads, which support the beams and which also have heads projecting between the panels. In use, after a concrete slab has been cast on the panels and the concrete of the slab has sufficiently hardened, parts of the dropheads carrying the beams and panels can be released for movement downwardly relative to the shores, thereby allowing the beams and the panels to the withdrawn downwardly from the newly cast concrete. The dropheads along with the shores remain in position to support the concrete.

Various prior art techniques and systems have been developed to provide quick shuttering and de-shuttering. One of such prior art discloses a slab formwork system for casting ceilings has panel support beams underlying and supporting formwork panels; and shores supporting the panel support beams. The panel support beams have upwardly facing top surfaces with upwardly open, longitudinally extending recesses and resiliently deformable strips of elastomeric material extending along the recesses. The formwork panels having marginal edge under surface portions mounted on the panel support surfaces and downwardly protruding panel retainer projections embedded in the resiliently deformable strips. The formwork panels each have a pair of parallel, elongate intermediate members extending between and interconnecting parallel elongate side members and a sheet of material supported on the side and intermediate members, and the side members have undersides formed with a longitudinally extending, downwardly open recesses. Connecting clips retained in the downwardly open recesses are engaged with the support beams to secure the formwork panels to the support beams. The panel support beams are telescopically longitudinally adjustable to allow corresponding variation of the spacings of the shores which have dropheads each having a first component forming a prop head extending between an adjacent pair of the formwork panels and a second component in supporting engagement with the formwork panels. The first and second components have mutually engaged screw threads allowing the second component to be lowered relative to the first component for releasing the formwork panels.

However, the prior art systems use props and drop head that demands a set of equipment and an experienced labour for shuttering and de-shuttering. This increase a time for installing and de-installing a formwork and hence, increase an installation and de-installation cost to a large extent.

In the view of foregoing, there is a need for a modular slab formwork system with a quick shuttering and de-shuttering assembly. Also, there is a need for a slab formwork system with rigid and shock-resistant panels and a drop head adapted to enable stable and fast installation of the formwork.

The above-mentioned shortcomings, disadvantages and problems are addressed herein, as detailed below.

C) OBJECT OF THE INVENTION

A primary objective of the embodiments in the present invention is to provide a modular slab formwork system with a quick shuttering and de-shuttering assembly.

Another objective of the embodiments in the present invention is to provide a slab formwork system with rigid and shock-resistant panel and a drop head adapted to enable stable and fast installation of the formwork.

Yet another objective of the present invention is to provide a slab formwork system with multiple side shuttering that allows faster installation.

These and other objects and advantages of the embodiments herein will become readily apparent from the following detailed description taken in conjunction with the accompanying drawings.

D) SUMMARY OF THE INVENTION

The various embodiments of the present invention provide a modular slab formwork system with easy shuttering and de-shuttering assembly. The formwork system comprises a formwork panel, a drophead and a prop. The formwork panel comprises a plurality of side connectors, a base frame, and a form-lining. The base frame comprises a corner element on each corner. The base frame has a chamfered corner with a slotted window and a bottom rim. The drophead is hooked to a slotted window of each corner element. The corner element facilitates locking of formwork panel with the drophead. The prop creates a vertical support to the formwork panel through the drophead over a ground surface.

According to one embodiment of the present invention, the drophead comprises a top plate, a fly plate, a wedge, a stem, a bottom plate and a locking bolt. The bottom rim of the corner element along with the drophead facilitates self-aligning of the formwork panel with the drophead.

According to one embodiment of the present invention, a base plate of the prop is connected to the bottom plate through the locking bolt. The stem is fixed at a central axis of the bottom plate and further connected vertically to the top plate respectively.

According to one embodiment of the present invention, the base frame is chamfered at an angle range of 40°-50° and at a preferable angle of 45° leading to a connection with a top plate of the drophead. The corner element slides into a fly plate of the drophead creating a locking action.

According to one embodiment of the present invention, the wedge has dual action of successive detachment of formwork panel by releasing the locking followed by gravity-based dropping of fly plate.

According to one embodiment of the present invention, the wedge comprises a side guiding and an inner sloping level. The fly plate is interlocked with the wedge through the side guiding.

According to one embodiment of the present invention, the fly pate comprises a fly plate pin hinged to the corner element. The fly plate pin is unhinged by applying a lateral force on the wedge leading to an angular movement of the fly plate through the inner sloping level.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

E) BRIEF DESCRIPTION OF THE DRAWINGS

The other objects, features and advantages will occur to those skilled in the art from the following description of the preferred embodiment and the accompanying drawings in which:

FIG. 1 illustrates a top perspective of an erected slab formwork, according to one embodiment of the present invention.

Figure 2A:
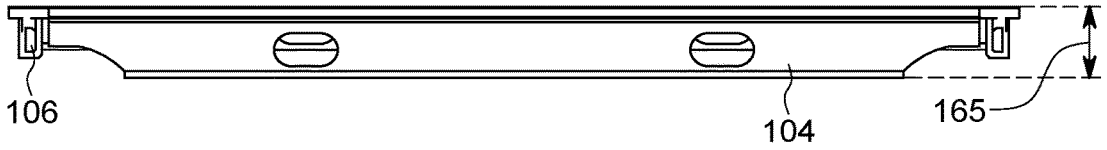
Figure 2B:
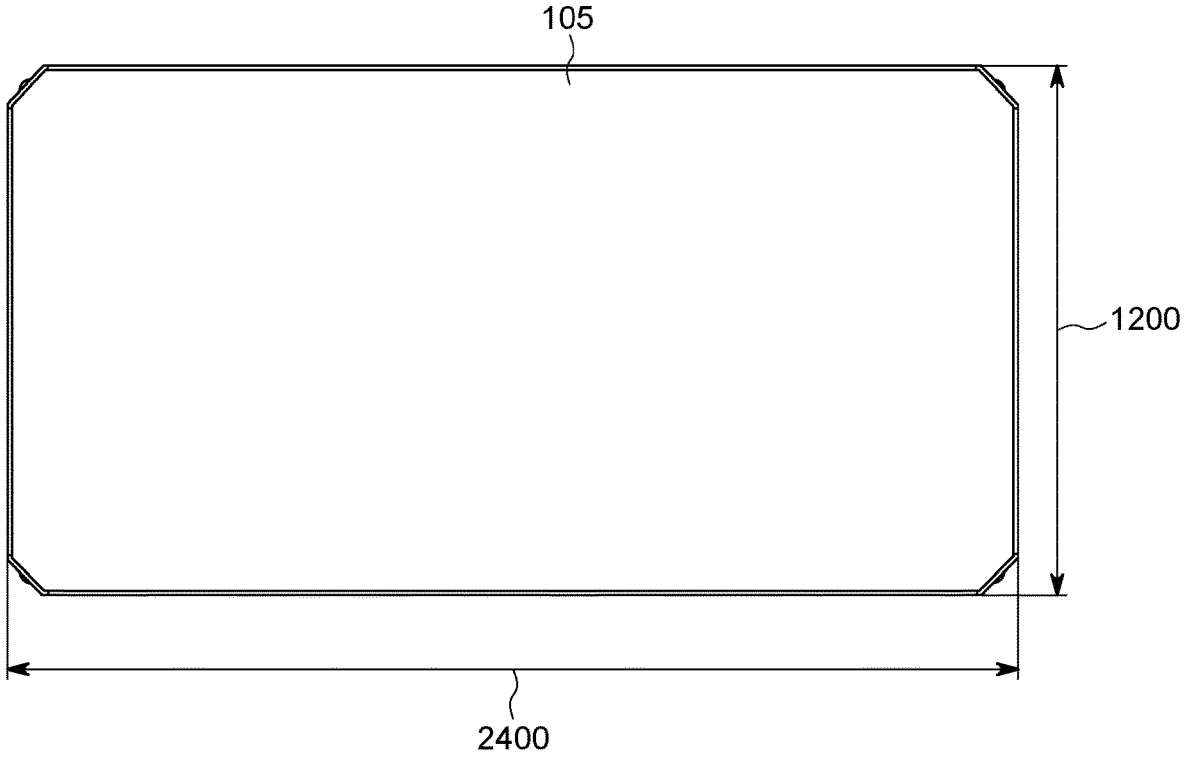

FIGS. 2*a* and 2*b* illustrates a side view and a top view respectively of a formwork panel, according to one embodiment of the present invention.

Figure 2C:
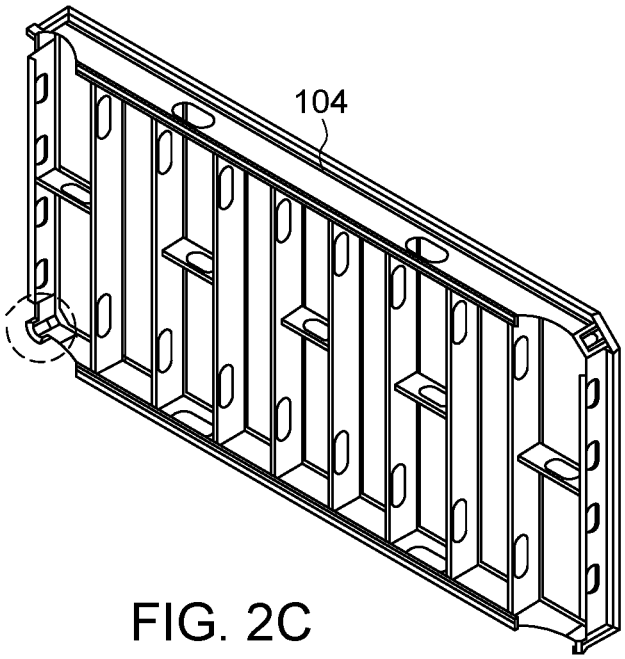
Figure 2D:
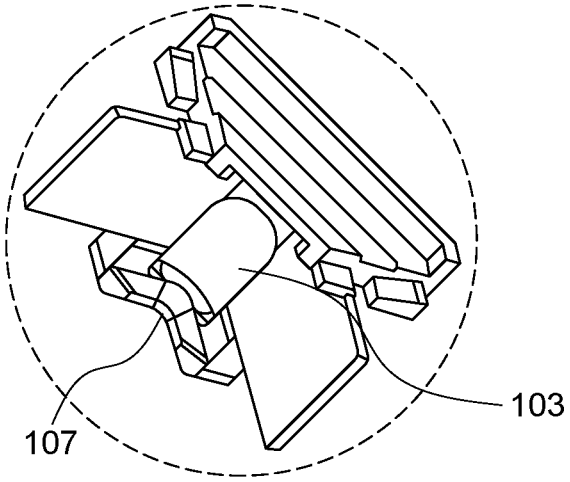
Figure 2E:
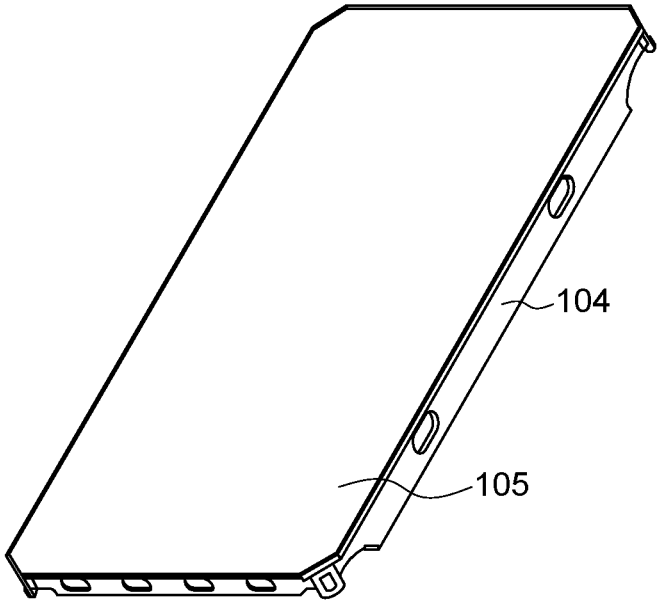
Figure 3A:
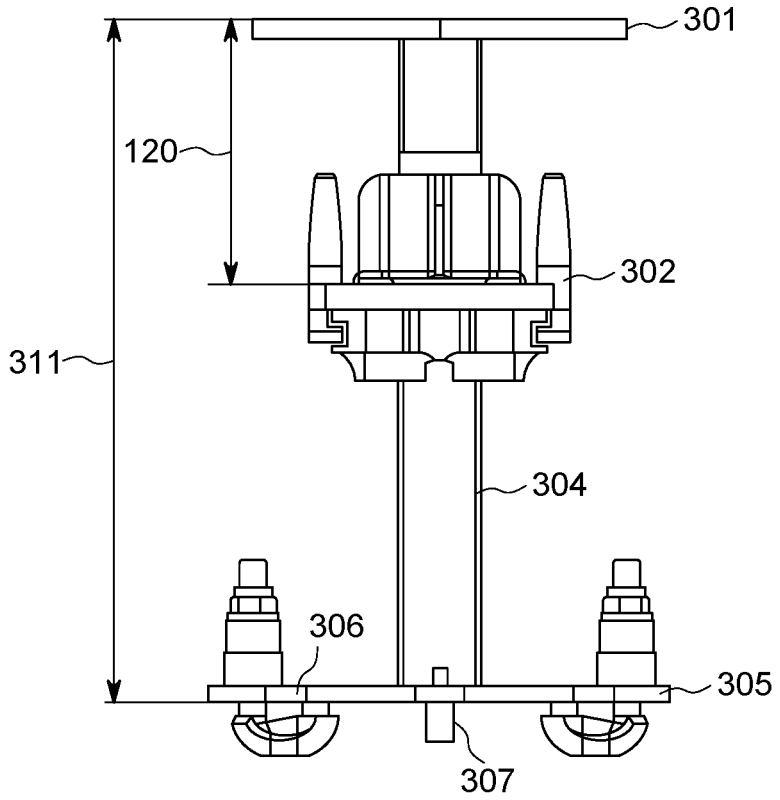
Figure 3B:
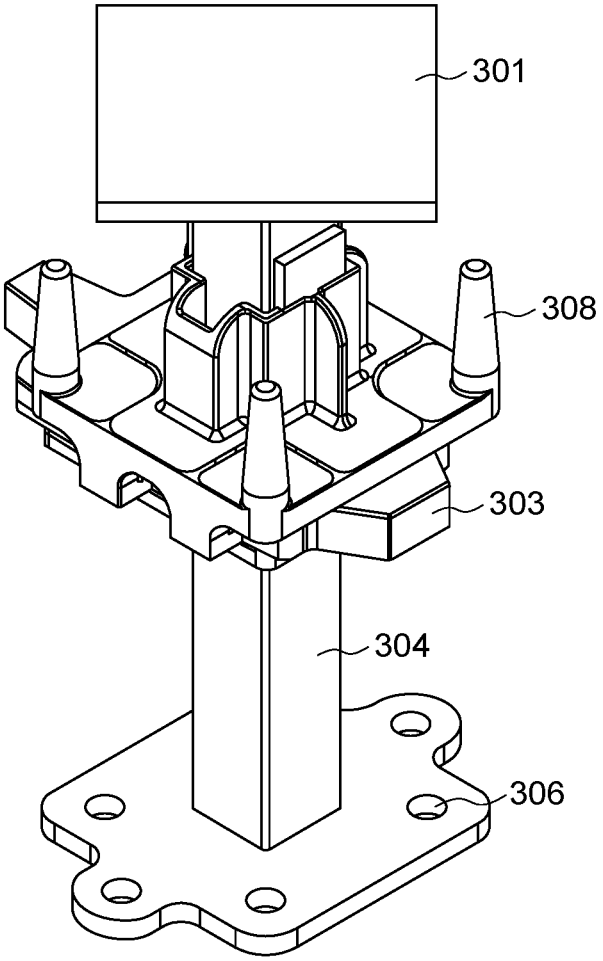
Figure 3C:
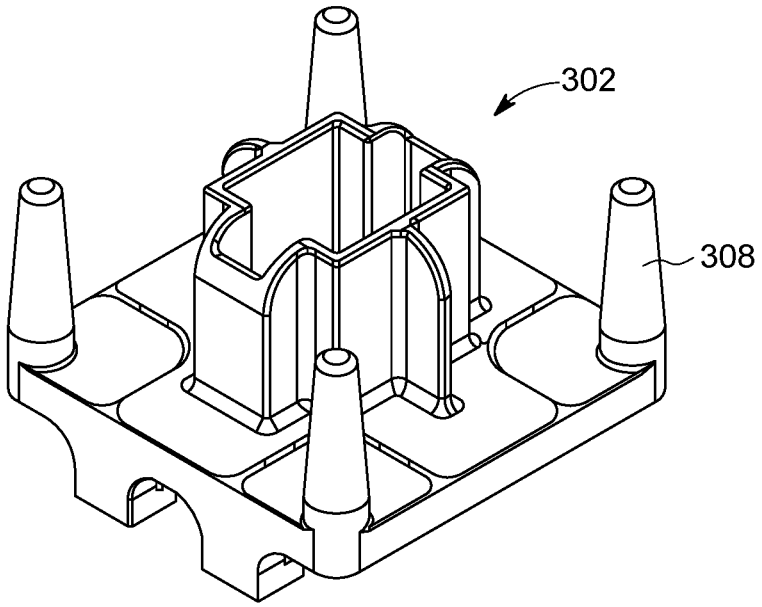
Figure 3D:
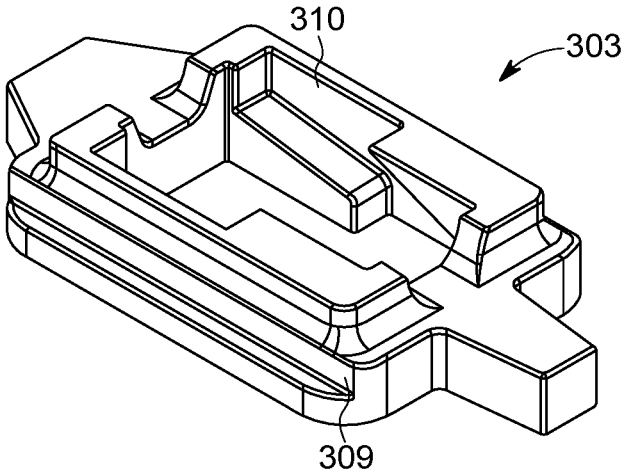

FIGS. 2*c* and 2*d* illustrates a bottom perspective view of the formwork panel and a view of a corner element, according to one embodiment of the present invention. FIG. 2*e* illustrate a top perspective view of the formwork panel according to one embodiment of the present invention.

FIGS. 3*a*, 3*b*, 3*c* and 3*d* illustrates a side view, a top perspective view of a drophead, a fly plate and a plurality of pins and a wedge respectively, according to one embodiment of the present invention.

F) DETAILED DESCRIPTION OF THE DRAWINGS

In the following detailed description, a reference is made to the accompanying drawings that form a part hereof, and in which the specific embodiments that may be practiced is shown by way of illustration. The embodiments are described in sufficient detail to enable those skilled in the art to practice the embodiments and it is to be understood that the logical, mechanical and other changes may be made without departing from the scope of the embodiments. The following detailed description is therefore not to be taken in a limiting sense.

FIG. 1 illustrates a top perspective of an erected slab formwork, according to one embodiment of the present invention. With respect to FIG. 1, the formwork comprises a formwork panel 101, a drophead 102, and a prop 108. The formwork panel 101 comprises a plurality of slotted windows 103, a base frame 104, and a form-lining 105 as shown in FIG. 2*a*-2*e*. The base frame 104 comprises a corner element 106 on each corner. The base frame 104 has a chamfered corner with the slotted window 103 and a bottom rim 107. The bottom rim 107 together with the drophead 102 and the fly plate pin 308 (shown in FIG. 3*b*) facilitates self-aligning of the formwork panel 101 with the drophead 102. The drophead 102 is hooked to a slotted window 103 of each corner element 106. The corner element 106 facilitates locking of at least two formwork panels 101 with the drophead 102 through the corner element 106. The drophead 102 is connected to each corner of the formwork panel 101 through the corner element 106.

With respect to FIG. 3*a*-3*d*, the drophead 102 comprises a top plate 301, a fly plate 302, a fly plate pin 308, a wedge 303, a stem 304, a bottom plate 305, a hole provision 306 for locking mechanism to the prop and a locking bolt 307. A base plate of the prop 108 is connected to the bottom plate 305 through the locking bolt 307. The stem 304 is fixed at a central axis of the bottom plate 305 and further connected vertically to the wedge and the top plate 301 respectively. The base frame 104 is chamfered at 45° leading to a connection with a top plate 301 of the drophead 102. The corner element 106 slides into a fly plate 302 of the drophead creating a locking action. The wedge 303 comprises a side guiding 309 and an inner sloping level 310. The fly plate 302 is interlocked with the wedge 303 through the side guiding 309. The fly pate 302 comprises a fly plate pin 308 to lock the fly plate in position by tightening of the wedge.

According to one embodiment of the present invention, the wedge has dual action i.e. if hammered in an opposite direction, the wedge releases the locking of the corner element from the fly plate pin followed by the gravity based dropping of panel and fly plate along with the wedge.

According to one embodiment of the present invention, a shuttering method of the slab formwork comprises the steps of:

a) Install first 3 props in length and width direction of the formwork panel and connect the bracing frames for lateral stability. The installation of the first 3 props creates the first bay. The props are preformed structure providing a vertical support to the erected formwork panel through dropheads.
b) Hang the first formwork panel on two sides of the installed props.
c) Use an erection aid and lift the panel, place it on the 3rd prop and keep it supported with the erection aid until the 4th prop is installed in the bay.
d) Continue and complete the next bay in similar sequence as provided in Steps a-c. The formwork panels can be erection in both length and width direction.
e) Fix the braces at regular intervals for providing lateral stability.
f) Once all the bays are completed, ensure that the infills are filled using a plurality of filler beams and a shuttering plywood.
g) Ensure that all the props are levelled once all the bays are completed and checked before reinforcement & concreting activities.

According to one embodiment of the present invention, a de-shuttering method of the slab formwork comprises the steps of:

a) Hammer the dropheads connected to the formwork panel. The wedge action of drophead ensures a panel-drop of 13 cm from the concreted surface.
b) Slowly lift up, tilt the first formwork panel and then lower the formwork panel. At least two persons are required for the de-shuttering process.
c) Slowly remove the subsequent panels in as explained in Steps (a) and (b).
d) Ensure that no prop is disturbed and is intact with the concreted surface during the de-shuttering.

According to one embodiment of the present invention, the props remain in place during the formwork stripping process thereby ensures faster slab cycle.

According to one embodiment of the present invention, the props having ground clearance of up to 5 m is possible using PERI props while the present prop is also compatible with various locally developed props if designed as per the PERI loading charts.

G) ADVANTAGES OF THE INVENTION

The present slab formwork allows a rapid shuttering and de-shuttering process using a less quantity of labour. Also, the chamfered corner of the formwork panel and the corner element allows self-centering and locking of the formwork panel into the dropheads without requirement of hammering, thus reducing a labour cost and complexity in assembly. The flyplate and wedge of the drophead provides locking of the corner element in position during the shuttering process and also, the dual action wedge ensures the release of corner element providing a safe deshuttering process ensuring detachment of panel during gravity drop of the fly-plate.

The slab formwork facilitates re-usability for upto 500 times due to rigid metallic base frame and minimum requirement of infills leading to less rupturing of the formwork panels.

It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the claims.

We claim:

1. A modular slab formwork with easy shuttering and de-shuttering assembly comprising:

a formwork panel, wherein the formwork panel comprises a base frame and a form-lining, wherein the base frame comprises a chamfered corner element on each corner;

a drophead comprising a top plate, a wedge, a stem, a bottom plate, and a locking bolt, wherein the drophead is connected to each corner of the formwork panel through the corner element; and a prop, wherein the prop creates a vertical support to the formwork panel through the drophead over a ground surface and wherein a base plate of the prop is connected to the bottom plate through the locking bolt;

wherein, a fly plate pin of the drophead is configured to hook to a slotted window of each corner element during erection, wherein the slotted window and a bottom rim of the corner element facilitates alignment of the corner element with respect to the drophead.

2. The slab formwork as claimed in claim 1, wherein the stem is fixed at a central axis of the bottom plate and further connected vertically to the wedge and the top plate respectively.

3. The slab formwork as claimed in claim 1, wherein a corner of the base frame is chamfered at an angle range 40°-50° leading to a connection with a top plate of the drophead.

4. The slab formwork as claimed in claim 3, wherein the wedge has dual action of successive detachment of the corner element of the formwork panel by releasing a hooked connection between the fly plate pin and the slotted window followed by gravity-based dropping of the fly plate.

5. The slab formwork as claimed in claim 1, wherein a corner of the base frame is chamfered at 45°.

6. A modular slab formwork with easy shuttering and de-shuttering assembly comprising:

a formwork panel, wherein the formwork panel comprises a base frame and a form-lining, wherein the base frame comprises a chamfered corner element on each corner;

a drophead comprising a top plate, a wedge, a stem, a bottom plate, and a locking bolt, wherein the drophead is connected to each corner of the formwork panel through the corner element; and a prop, wherein the prop creates a vertical support to the formwork panel through the drophead over a ground surface and wherein a base plate of the prop is connected to the bottom plate through the locking bolt;

wherein, a fly plate pin of the drophead is configured to hook to a slotted window of each corner element during erection, and wherein the slotted window, a bottom rim, and a chamfered portion of the corner element facilitates alignment of the corner element with respect to the drophead such that the formwork panel aligns with the top plate of the drophead.

7. A modular slab formwork with easy shuttering and de-shuttering assembly comprising:

at least one formwork panel, each comprising a base frame and a form-lining, wherein the base frame comprises a chamfered corner element on each corner;

a drophead comprising a top plate, a wedge, a stem, a bottom plate, and a locking bolt, wherein the drophead is connected to at least one corner of the at least one formwork panel through the corner element; and a prop, wherein the prop creates a vertical support to the at least one formwork panel through the drophead over a ground surface and wherein a base plate of the prop is connected to the bottom plate through the locking bolt;

wherein, a fly plate pin of the drophead is configured to hook to a slotted window of each corner element during erection, wherein the slotted window and a bottom rim of the corner element facilitates alignment of the corner element with respect to the drophead and facilitates alignment of a first formwork panel of the at least one formwork panel with a second formwork panel of the at least one formwork panel.

* * * * *